US012139989B1

(12) United States Patent
Al-Mousa et al.

(10) Patent No.: US 12,139,989 B1
(45) Date of Patent: Nov. 12, 2024

(54) COMPACTION AND FISHING SPEAR FOR WIRELINE LOST DOWNHOLE AND METHOD OF USE

(71) Applicant: SAUDI ARABIAN OIL COMPANY, Dhahran (SA)

(72) Inventors: Ahmed A. Al-Mousa, Dhahran (SA); Mohammed M. Alibrahim, Al Qatif (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/321,508

(22) Filed: May 22, 2023

(51) Int. Cl.
*E21B 31/12* (2006.01)

(52) U.S. Cl.
CPC ..... *E21B 31/125* (2013.01)

(58) Field of Classification Search
CPC ..... E21B 31/12; E21B 31/125
See application file for complete search history.

(56) References Cited

U.S. PATENT DOCUMENTS

| | | | | |
|---|---|---|---|---|
| 1,749,869 | A * | 3/1930 | Baumbach | E21B 31/18 294/86.27 |
| 2,345,727 | A * | 4/1944 | Burch | E21B 31/125 294/86.23 |
| 3,758,145 | A * | 9/1973 | Kinley | E21B 31/12 294/86.23 |
| 5,106,140 | A | 4/1992 | Knotts | |
| 8,397,815 | B2 | 3/2013 | MacDougall et al. | |
| 2004/0031604 | A1 * | 2/2004 | Huggins | E21B 31/125 166/98 |

* cited by examiner

*Primary Examiner* — Dany E Akakpo
(74) *Attorney, Agent, or Firm* — Osha Bergman Watanabe & Burton LLP

(57) ABSTRACT

A system includes a spear hook for gripping into a compacted wireline, a spear that deploys the spear hook, and a hook hinge rotatably coupling the spear hook to the spear. The tool also includes a hook activator mounted in the spear to cause expansion and contraction of the spear hook. The spear hook expands and contracts along a path defined by the hook hinge in a radial direction from a spear outer surface of the spear. The tool also includes a compaction component, coupled to the spear, for compacting a wireline to form the compacted wireline.

18 Claims, 8 Drawing Sheets

COMPACTION AND FISHING SPEAR FOR WIRELINE LOST DOWNHOLE AND METHOD OF USE

BACKGROUND

Fluids are typically produced from a reservoir in a subterranean formation by drilling a wellbore into the subterranean formation, establishing a flow path between the reservoir and the wellbore, and conveying the fluids from the reservoir through the wellbore to a destination such as to the surface of the earth, to a bed of a body of water such as a lakebed or a seabed, or to a surface of a body of water such as a swamp, a lake, or an ocean (hereafter "surface.") Fluids produced from a hydrocarbon reservoir may include natural gas, oil, and water.

In the course of drilling and completing boreholes to produce oil and gas from subterranean reservoirs, or while stimulating and producing hydrocarbons from subterranean reservoirs, it is not uncommon for equipment to be dropped into the borehole from the surface or for downhole tools and equipment to become separated from their conveyor. When this occurs, it is frequently necessary to retrieve the dropped equipment or separated downhole tools from the borehole before normal drilling, completing, stimulating, or producing operations may continue. This process of retrieval is commonly called "fishing" and the equipment or tools to be retrieved are commonly called "fish."

An example of a fish is wireline that is lost downhole and, in that case, any downhole tool that may still be connected to the wireline. Hooking the wireline may result in retrieving the downhole tool as well. Lost wireline is challenging to grapple, grip, or hook using traditional fishing tools and may result in multiple trips. Making several trips can be a costly and time-consuming procedure. During fishing operations, a specialized tool may be required to hook to the lost wireline to avoid making several trips downhole to grapple the fish.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

This disclosure presents, in accordance with one or more embodiments, a borehole fishing tool, including a spear hook for gripping into a compacted wireline, a spear that deploys the spear hook, and a hook hinge rotatably coupling the spear hook to the spear. The tool also includes a hook activator mounted in the spear to cause expansion and contraction of the spear hook. The spear hook expands and contracts along a path defined by the hook hinge in a radial direction from a spear outer surface of the spear. The tool also includes a compaction component, coupled to the spear, for compacting a wireline to form the compacted wireline.

This disclosure presents, in accordance with one or more embodiments, a borehole fishing method, including attaching, to a conveyor, a borehole fishing tool. The tool includes a spear and a compaction component coupled to the spear. The spear is initially mounted in a recessed position within the borehole fishing tool. The method includes inserting the borehole fishing tool attached to the conveyor into a borehole. The method includes receiving, with the spear in a recessed position, a wireline. The method includes compacting, using the compaction component of the borehole fishing tool and a downhole force provided by the conveyor, the wireline to form a compacted wireline. The method includes activating the spear from the recessed position to an activated position. The method includes releasing, using a hook activator, a spear hook from a latched position to an outside position. The method includes engaging, using the spear in the activated position and the spear hook in the outside position, the borehole fishing tool to the compacted wireline, and raising the borehole fishing tool and the compacted wireline in an uphole direction until exiting of the borehole.

Other aspects and advantages of the claimed subject matter will be apparent from the following description and the appended claims.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Regarding the figures described herein, when using the term "down" the direction is toward or at the bottom of a respective figure and "up" is toward or at the top of the respective figure. "Up" and "down" are oriented relative to a local vertical direction. However, in the oil and gas industry, one or more activities take place in a vertical, substantially vertical, deviated, substantially horizontal, or horizontal well. Therefore, one or more figures may represent an activity in deviated or horizontal wellbore configuration. "Uphole" may refer to objects, units, or processes that are positioned relatively closer to the surface entry in a wellbore than another. "Downhole" may refer to objects, units, or processes that are positioned relatively farther from the surface entry in a wellbore than another. True vertical depth is the vertical distance from a point in the well at a location of interest to a reference point on the surface.

Embodiments disclosed herein relate to a fishing tool specialized in design to hook wireline that is lost downhole. The lost wireline may be collapsed down near the bottom of the hole. The collapsed wireline may be loosely bundled at the bottom of the hole. Utilizing a fishing tool specialized for loosely-bundled lost wireline allows for the fishing tool to properly hook lost wireline.

Figure 1:
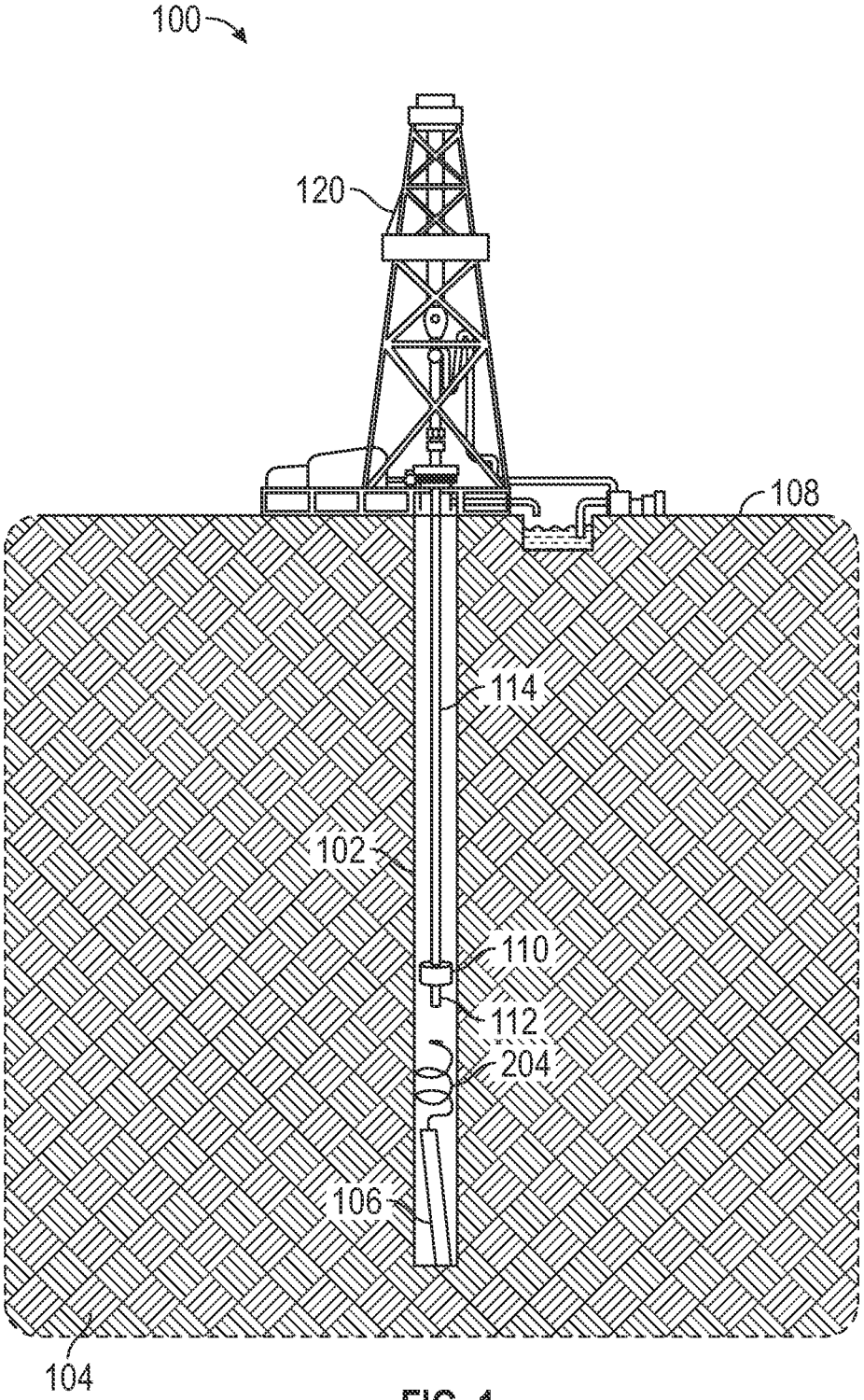
FIG. 1 shows a system in accordance with one or more embodiments.

FIG. 1 shows a schematic diagram in accordance with one or more embodiments. FIG. 1 illustrates a well environment (100) that includes a borehole (102), which may penetrate a subterranean region (104). The borehole (102) may contain a fish (e.g., fish 106). The fish may be a piece of equipment, a downhole tool, or a piece of completion, such as a portion of casing or tubing. The fish (106) may have been accidentally dropped into the borehole from the surface of the earth, e.g., surface (108). The fish (106) may have become accidentally separated from a conveyor (114) of the fish. The fish (106) may have become stuck in the borehole (102) and been deliberately separated from the conveyor (114). The fish may be the conveyor itself, such as lost wireline, e.g., a wireline (204). The lost wireline may still be connected to a lost wireline tool and fishing out the lost wireline may also fish out the lost wireline tool.

FIG. 1 further illustrates, in accordance with one or more embodiments, a borehole fishing tool, e.g., tool (110), deployed within the borehole (102). The tool may be attached to a conveyor first end 116 of a conveyor (114). The conveyor (114) may extend from the tool to the surface (108). A second end of the conveyor (114) may be attached to a means of suspension at the surface. The means of suspension may be, for example, a rig (120), a coiled tubing unit (not illustrated), or a crane and winch (not shown).

The conveyor (114) of the tool shown in FIG. 1 may, in accordance with one or more embodiments, be capable of inserting the tool into the borehole (102) and conveying and retrieving the tool from at least a portion of the borehole (102). The conveyor (114) may be selected from a group consisting of a slickline, a wireline, a coil tubing, a wired coil tubing, a drill string of drill pipe, or a wired drill string of wired drill pipe. Other options for the conveyor are contemplated and would be acceptable for use in other embodiments. In accordance with one or more embodiments the conveyor may be the drill string and the first end of the conveyor may be a connection to the drill pipe. The conveyor (114) may be connected to the tool with a connector (not shown). The connector may be an API standard tool joint as specified in ISO 11961:2018, and ISO 10424-2:2007 published by the International Organization for Standardization, or API Spec 7-2 published by the American Petroleum Institute. In other embodiments, the tool may connect directly to the conveyor (114). Further, the conveyor (114) of the tool may be capable of lowering the tool into a substantially vertical borehole, e.g., borehole (102), and may be capable of pushing the tool into a highly deviated borehole and/or a horizontal borehole. The tool may be equipped with a spear (112), in accordance with one or more embodiments. The spear (112) may be capable of fixedly attaching to the fish (106) in such a manner as to connect the tool to the fish (106).

Figure 2:
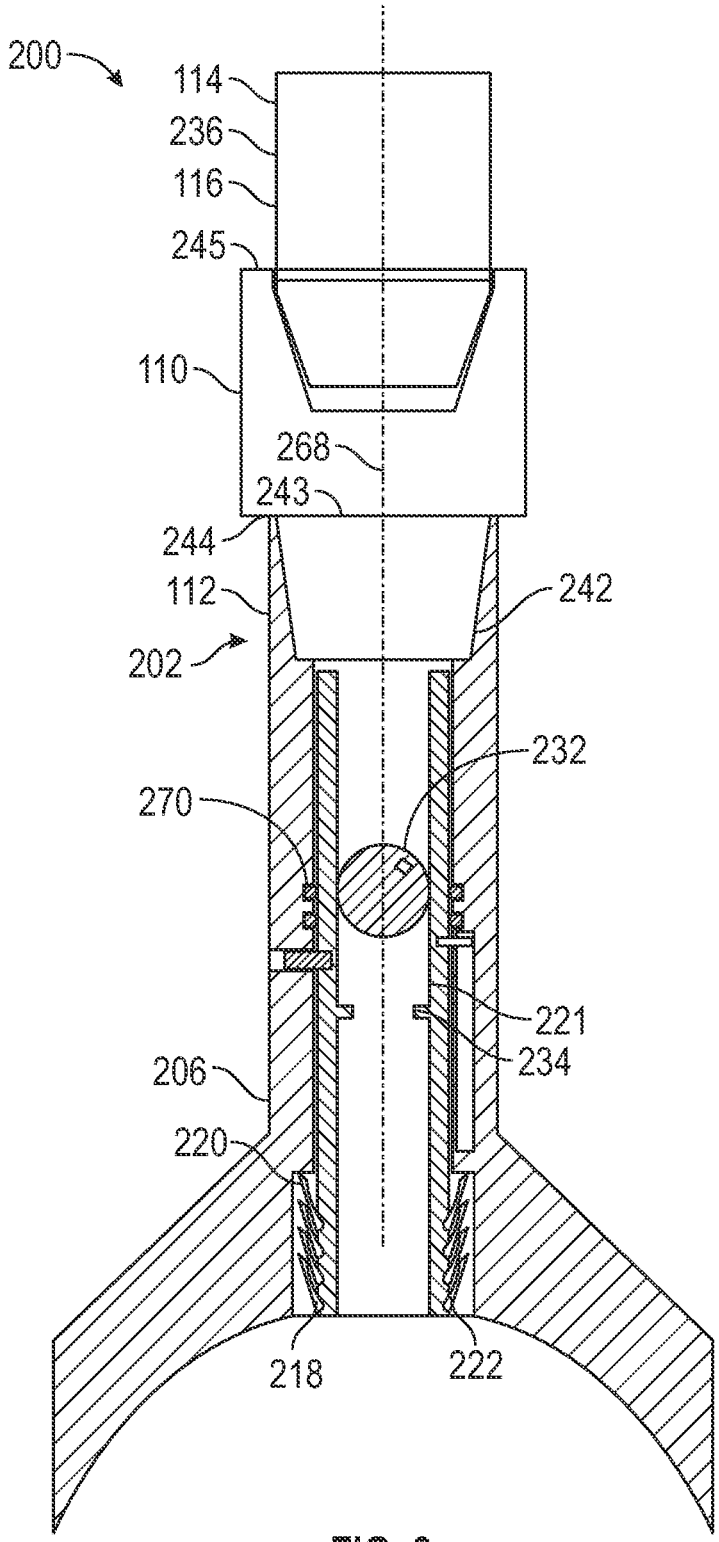
FIG. 2 shows an example of a system in accordance with one or more embodiments.

FIG. 2 shows an example of a system (200) in accordance with one or more embodiments. Spear system, e.g., system (200), has the borehole fishing tool, e.g., tool (110), coupled to a spear assembly, e.g., spear (112). The spear (112) uses two main bodies that are joined by a weakpoint connection, e.g., a weakpoint (250), and a scaling mechanism, e.g., a seal (270). The spear (112) has compaction component (206) and a spear component (218). Apparatus (202) comprises the spear (112) and an actuation ball, e.g., ball (232), configured to actuate the spear component (218). A ball seat (234) may be coupled to a spear bore (221) within a spear body (220). Spear component (218) is translatably coupled along an activation path that may be parallel to, at an angle to, or colinear with a central axis of the spear (112), e.g., a spear axis (268). A weak point connection, e.g., a weakpoint (250) provides a releasable connection between the spear component (218) and the compaction component (206). The weakpoint holds the spear component (218) substantially static with respect to the compaction component (206).

The spear system is shown conveyed by, for example, the conveyor (114). An example of the conveyor is drill pipe (236). The spear system is conveyed to a downhole location within the borehole. Compaction component (206) has an uphole end, e.g., spear second end (244) comprising a spear connector (242) configured to couple to a tool first end (243) of the tool (110). Conveyor first end (116) may be configured to couple to a tool second end (245).

Figure 3A:
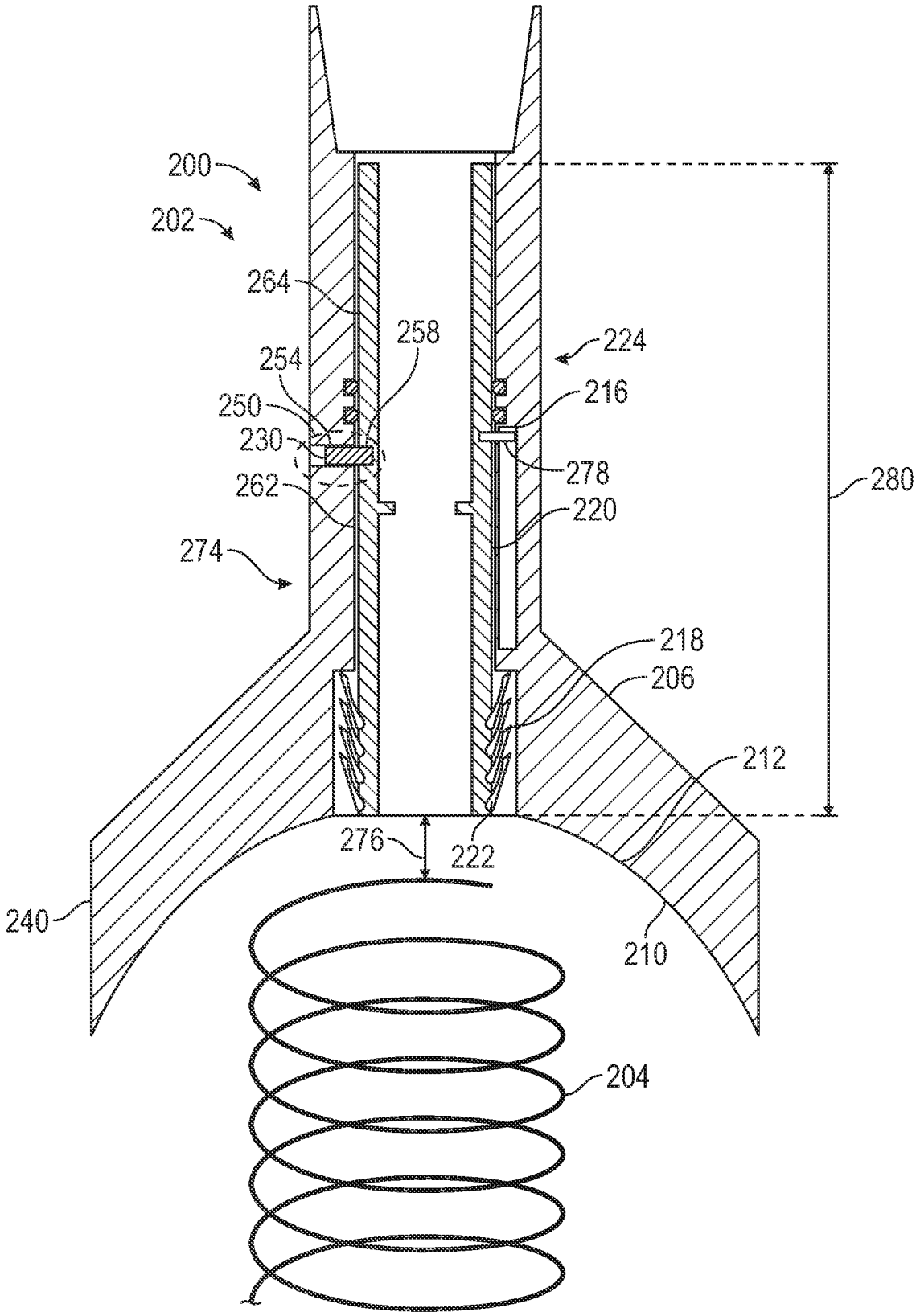
FIGS. 3A, 3B, and 3C show an apparatus and a spear in accordance with one or more embodiments.
Figure 3B:
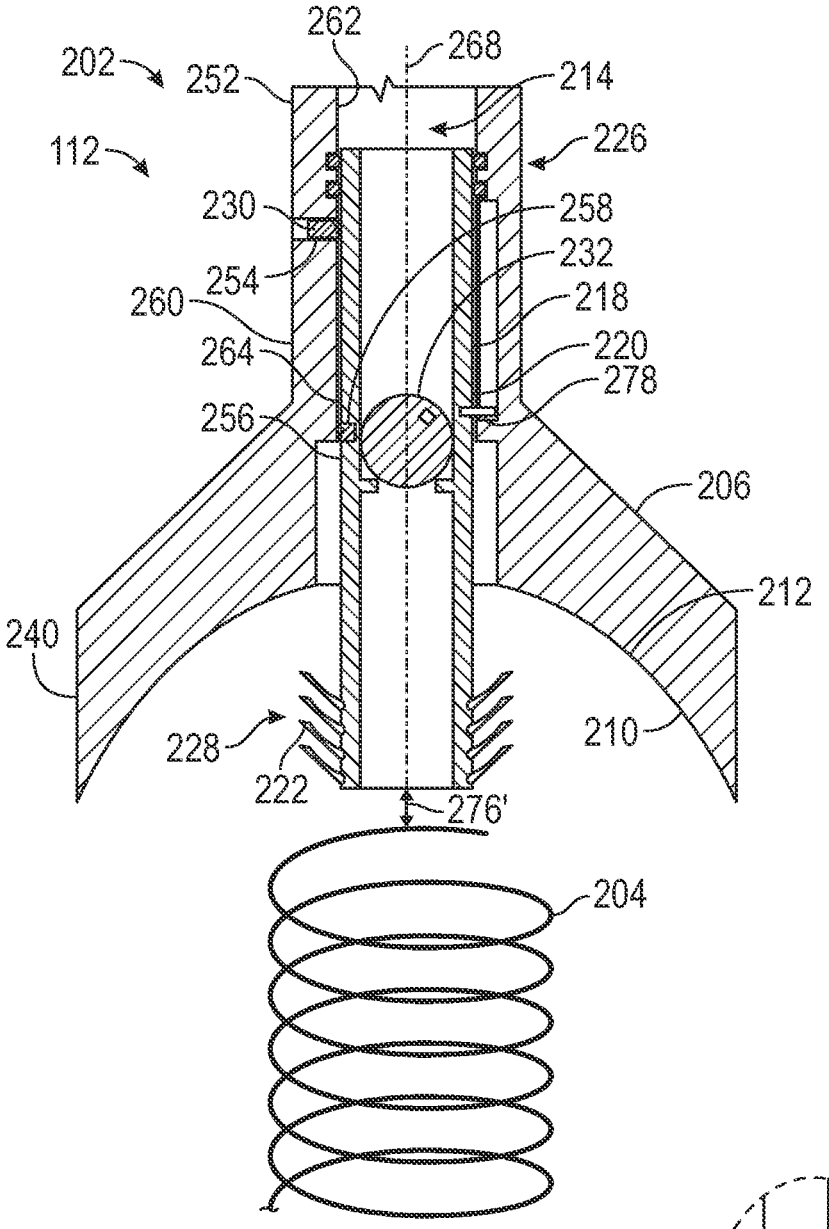
Figure 3C:
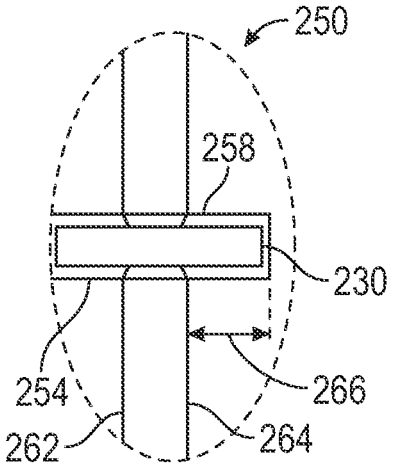

FIGS. 3A and 3B show the apparatus (202) and the spear (112) in accordance with one or more embodiments. FIG. 3A and FIG. 3B show a cross-sectional view of the apparatus (202). FIG. 3C is an expanded view of a portion of FIG. 3A.

FIG. 3A shows that the spear (112) has a recessed position in which the spear component (218) is in a retracted position, e.g., inactivated spear position (224), within a spear recess (214) within the compaction component (206). The recessed position may allow the wireline (204) to enter the compaction component. For example, with the spear (112) in the inactivated spear position (224), then the wireline (204) has more space, e.g., a space (276), to fit inside the concave surface, e.g., a compaction bore (210), at a spear first end (240). In this manner the recessed position allows the wireline to enter the compaction component. In addition, the compaction component (206) has a spear latched position (274) wherein the spear hooks, e.g., spear hook (222), are held in a retracted position such as by being confined close to the spear body (220) outside diameter, e.g., second outer surface (264). The spears may be held in the retracted position, e.g., the spear latched position (274), by an inner wall, e.g., a skirt portion inner surface (262), of the skirt portion (252) of the compaction component (206).

FIG. 3B shows the spear recess (214) within the compaction component (206). Spear recess (214) is defined, for example, by the skirt portion inner surface (262) and a recess depth (280). The actuation ball actuates the spear component (218) by releasing the weak point connection (e.g., shearing the shear pin 230) thereby extending the spear component (218) from an inactivated spear position (224 FIG. 3A) to an activated spear position (226). In the activated position the spear is exposed downhole, i.e., the spear extends out of spear recess (214) to be located further away, axially, from the compaction bore (210), thereby exposing it to the environment downhole of the compaction bore (210). The activated spear position (226) results in less space, e.g., space (276') in comparison with space (276) for the wireline (204) to enter the compaction bore (210).

Extending the spear component (218) includes translating the spear component (218) along the activation path, e.g., spear axis (268). The extent of the travel may be limited by a spear travel slot, e.g., a slot (216 FIG. 3A) disposed in the compaction component 206. The slot 216 cooperates with a pin, e.g., a travel stop (278) to limit the travel of the spear component 218. The slot 216 and the travel stop 278 also cooperate to limit and/or prevent rotation between compaction component 206 and spear body 220. The travel stop 278 is coupled to the spear body 220 and thereby limits the travel of the spear component 218. Uphole travel of the spear component 218 is limited by, for example, contact between the travel stop 278 and the uphole end of the slot 216. Downhole travel of the spear component 218 is likewise limited by contact between the travel stop 278 and the downhole end of the slot 216.

The compaction component 206 and/or the spear body 220 may have a travel stop access port for removal and installation of the travel stop 278. The travel stop access port may provide a liquid-tight, gas-tight, and/or pressure tight seal between the first outer surface 260 and the skirt portion inner surface 262. The travel stop access port may provide a liquid-tight, gas-tight, and/or pressure tight seal between the spear bore 221 and the second outer surface 264. Likewise, the weakpoint 250 may provide a liquid-tight, gas-tight, and/or pressure tight seal between the first outer surface 260 and the skirt portion inner surface 262.

The means of translatably coupling the spear component (218) to the compaction component (206) may include fasteners such as studs, nuts, screws, bolts, and pins engaging the spear component (218), e.g., through a hole or slot in the spear component. The coupling may further use a dovetail slot on one or both of the spear component or the compaction component and a mating dovetail rail on the other of the spear component or the compaction component. The coupling may include one or more sliding bearings such as a ball bearing, cylindrical roller bearing, spherical roller bearing, tapered roller bearing, and/or journal bearing on one or both of the spear component or the compaction component and a mating sliding surface. The means for translating may include a downhole pushing force.

The downhole pushing force may be derived from hydraulic pressure applied to the ball (232) and conveyed through the ball seat (234) mounted on the spear bore (221) within the spear body (220) to the spear component (218). The means for translating may include one or more motors (such as an electrically-powered motor), linear actuators, electro-magnets, solenoids, hydraulic cylinders, gears, levers, or jack screws and/or latches, locks, or braking mechanisms.

FIG. 3B shows that the compaction component (206) has a skirt portion (252) with a first outer surface (260) and a skirt portion inner surface (262). The spear body (220) has an extending portion (256) with a second outer surface (264). Spear body (220) of spear component (218) fits into compaction component (206) in a bore, e.g., spear recess (214), defined by skirt portion inner surface (262) within skirt portion (252). Compaction component (206) has the concaved surface, the compaction bore (210), disposed at a downhole end of the compaction component (206), e.g., the spear first end (240). The tool compaction bore, e.g., compaction bore (210), of the compaction component (206) has a smooth, inwardly curved (concaved) compaction surface that may prevent the apparatus (202) from damaging the loose wireline string, e.g., wireline (204). The compaction bore (210) may enhance compaction to significantly increase the chance of capturing the loose wireline string with the spear. Compaction bore (210) may have at least one of a groove, e.g., a compaction bore groove (212), located on the compaction surface.

FIGS. 3A, 3B, and 3C show that the weak point connection may use one or more of a shear pin for the releasable connection. The skirt portion (252) may have an outer shear pin aperture, e.g., outer aperture (254), and the extending portion (256) may have an inner shear pin aperture, e.g., inner aperture (258). The spear may then use a shear pin (230) installed within the inner shear pin aperture and the outer shear pin aperture. Outer aperture (254) is disposed in the wall thickness penetrating from the first outer surface (260) to a skirt portion inner surface (262) of the skirt portion (252). Inner aperture (258) penetrates from the second outer surface (264) to a shear pin aperture depth (266).

The weakpoint holding the spear component (218) and the compaction component (206) together may comprise one or more of the shear pins, e.g., shear pin (230). The weakpoint (250) may comprise a material cross-section calibrated for a load capacity and to fail or shear at a preselected value exceeding the load capacity. The load capacity may be preselected for an expected ball force. The weakpoint may be configured to release at a calibrated parting force applied by the downhole pushing force resulting from the expected ball force.

The calibrated parting force is calibrated by configuring the weakpoint to release at a predetermined parting force exceeding a preselected load capacity. For example, with the use of a shear pin or shear pins, the shear pins are calibrated to shear at a predetermined shearing force. In the case of material cross-section, the calibrated parting force is calibrated by configuring the mechanical weak point to release at the predetermined parting force. Other options for the weak point connection, e.g., weakpoint (250), are contemplated and would be acceptable for use in other embodiments. For example, a ratcheting connector may be used for the weakpoint (250). Other options for generating the parting force are contemplated and would be acceptable in other embodiments. For example, the spear component (218) may be deployed using electric power provided by batteries coupled to the tool (110) or from electric power conveyed from the surface. The electric power may be used to power an electric motor to deploy the spear component.

Figure 4A:
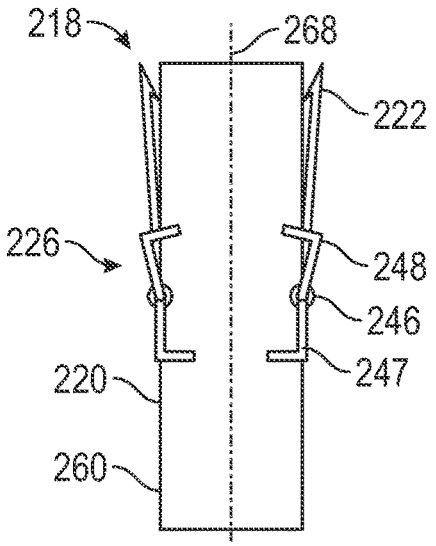
FIGS. 4A-4F show a spear component with a spear hook in accordance with one or more embodiments.
Figure 4D:
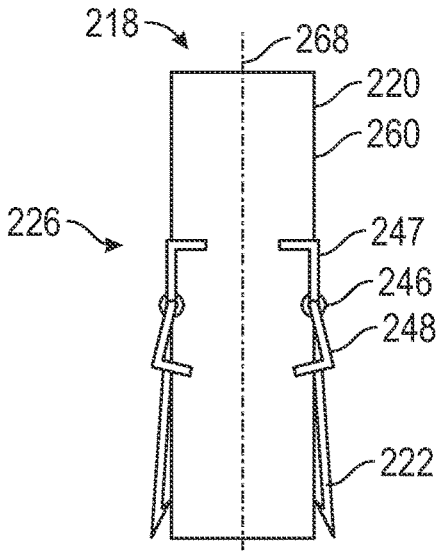
Figure 4B:
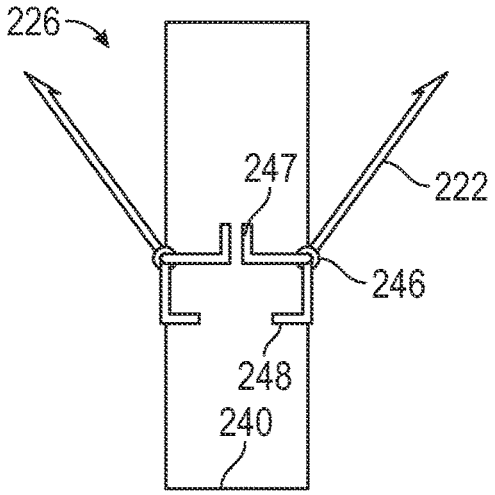
Figure 4E:
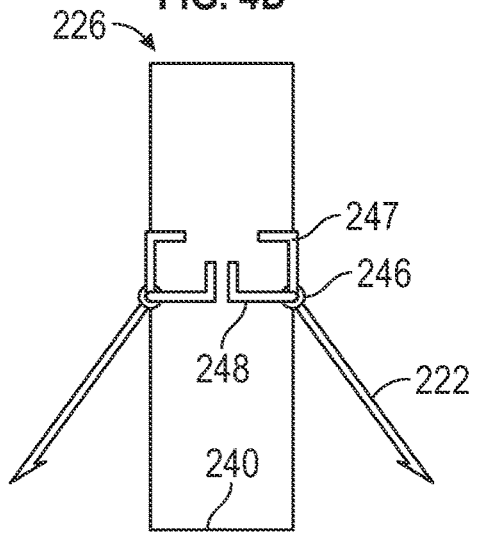
Figure 4C:
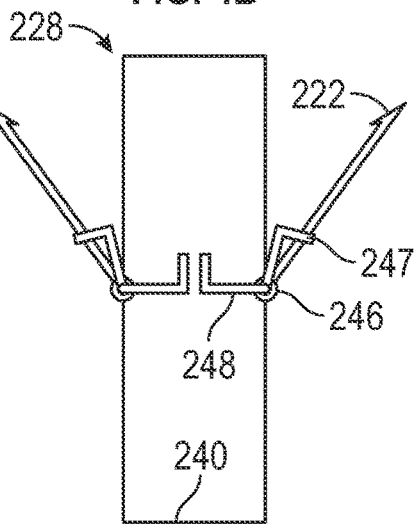
Figure 4F:
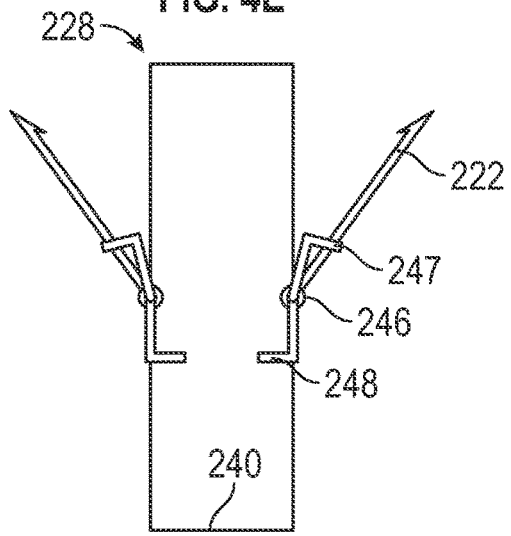

FIGS. 4A-4F show the spear component (218) with the spear hook (222). FIGS. 4A-4C show an embodiment in which the spear hooks rotate from uphole toward downhole. FIGS. 4D-4F show an embodiment in which the spear hooks rotate from downhole toward uphole. Spear component (218) has the spear body (220) and at least one of a spear hook (222). The spear hook is configured for gripping the wireline. A hook hinge (246) rotatably couples the spear hook (222) to the spear body (220). Hook hinge (246) is configured to define the path of the rotational motion of the spear hook (222). A hook activation component, e.g., a hook activator (248), mounted in the spear (112) provides the means of retaining the spear hooks in a nondeployed position. The hook activator (248) also provides the means of releasing the spear hooks out of the spear body (220), deploying the spear hooks away from the spear axis (268) and toward the spear first end (240), and rotating the spear hooks along the rotatably coupled motion path defined by the hook hinge (246). In this manner the hook activator (248) causes the expansion and contraction of the spear hook. A hook lock (247) locks the hooks in their deployed positions. In accordance with one or more embodiments the hook lock (247) may be incorporated in the hook hinge (246) and/or the hook hinge (246) may be incorporated in the hook lock (247).

FIG. 4A and FIG. 4D show the spear component (218) in the activated spear position (226) before the spear hook (222) is released. Hook activator (248) holds the spear hook 222 at the nondeployed position.

FIG. 4B and FIG. 4E show the spear hook (222) after being released by the hook activator (248) and before the spear hook (222) reaches the deployed position. Deploying the spear hooks away from the spear axis may comprise, for example, an expansion of the spear hook in a radial direction away from a spear outer surface, e.g., a second outer surface (264). Retracting the spear hooks toward the spear axis comprises a contraction of the spear hook in a radial direction toward the spear outer surface. In FIG. 4B deploying the spear hooks in an axial direction moves the spear hooks toward the spear first end (240). Retracting moves them in an axial direction away from the spear first end (240). In FIG. 4E deploying the spear hooks in an axial direction moves the spear hooks away from the spear first end (240). Retracting moves them in an axial direction toward the spear first end (240).

FIG. 4C and FIG. 4F show the spear hook (222) in the deployed position such as a released spear position, e.g., outside position (228). In the deployed position the hook lock (247) locks the hook in the deployed position.

The means of rotatably coupling, retaining releasing, deploying, and locking the spear hook (222) to and from the spear body (220), e.g., the hook hinge (246), the hook lock (247), and the hook activator (248), may include fasteners such as studs, nuts, screws, bolts, and pins engaging the spear hook, e.g., through a hole or slot in the hook. The coupling may include one or more rotatable bearings such as a ball bearing, cylindrical roller bearing, spherical roller bearing, tapered roller bearing, and/or journal bearing on one or both of the rotatable spear hook or the spear body. The coupling may include a mating shaft or axle, pin, stud, or rod on the other of the rotatable spear hook or the spear body. The means for rotating may include one or more springs, metallic springs, gas-charged springs, motors, linear actuators, electro-magnets, solenoids, hydraulic cylinders, gears, or jack screws and/or latches, locks, or braking mechanisms. Electrically-operated means for rotating may be powered by a battery or batteries, or by an external power source, electrically coupled to the electrically-operated means. Deploying the spear hooks may be initiated by a deploy command to deploy the spear hooks sent from a control system and obtained by the system (200). Those skilled in the art will readily appreciate that the means for coupling and the means for translating combining fasteners, bearings, and actuators may be configured without departing from the scope of this disclosure.

Figure 5A:
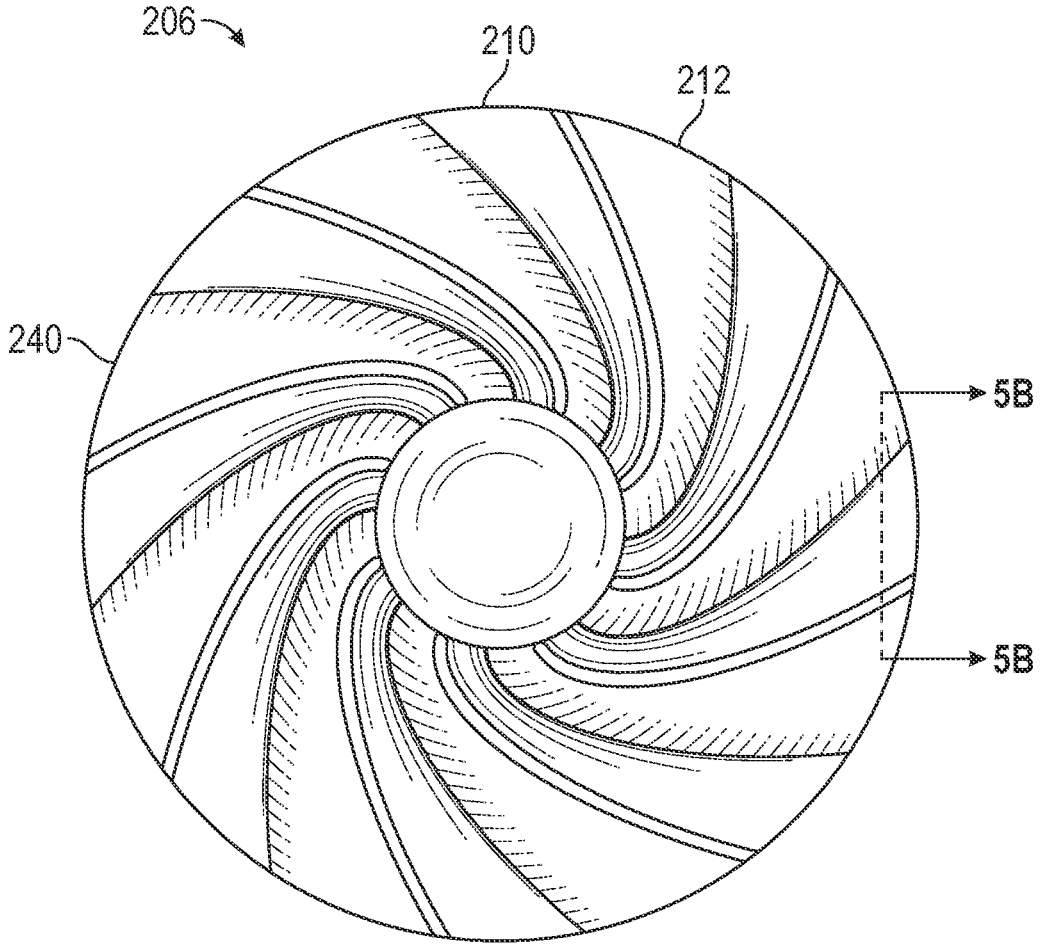
FIGS. 5A-5B respectively show an end view and cross-sectional view of a compaction component in accordance with one or more embodiments.
Figure 5B:
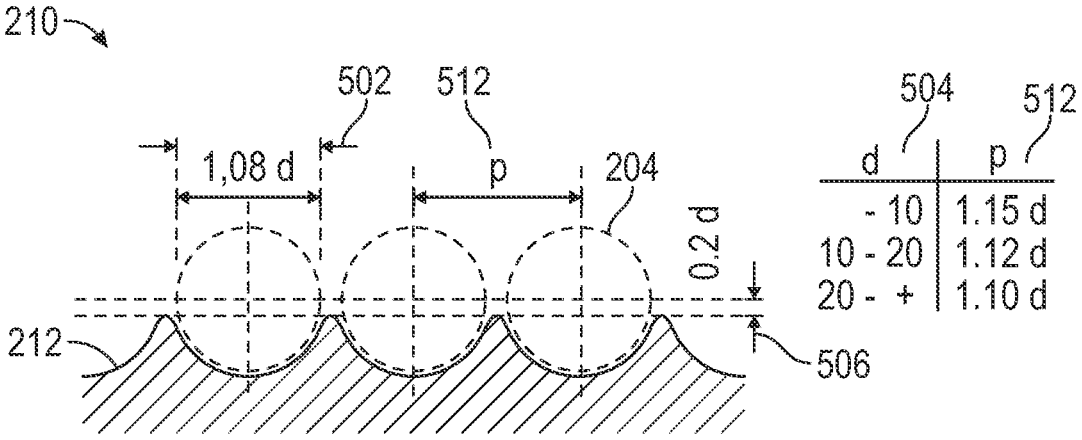

FIGS. 5A-5B show the compaction component 206 in accordance with one or more embodiments. FIG. 5A is an end view. FIG. 5B is a cross-sectional view along 5B-5B. To keep the compressed wireline from blocking the pathway of the spear, grooves, e.g., compaction bore groove (212) may be disposed inside the concaved surface bore, e.g., compaction bore (210) of the compaction tool. Compaction bore groove (212) is configured to allow the wireline, e.g., wireline (204), to accumulate without preventing the spear from reaching the bottom after activation. The grooves and the compaction bore cooperate to accumulate the wireline and leave enough space remaining below the compaction bore to provide clearance for the spear to move from the inactivated spear position (224) to the activated spear position (226). If there is no proper space for the wire to accumulate and hang, the wire might remain underneath the spear causing the tool not to properly engage or activate the fish.

For example, the grooves in the compaction bore may be similar to the groove detail shown in FIG. 5B. The grooves are shown with a cross-section of wireline 204 accumulated in the grooves. The grooves may further assist in preventing the wire from blocking the spear pathway to fully extend during activation phase by allowing and providing room for the wire to accumulate around the grooves during compaction.

FIG. 5B shows that the grooves may be sized as a function of the size of wireline to be compacted. For example, the groove width 502 may be determined by multiplying a wireline diameter 504 with a groove width factor of 1.08. A groove peak offset 506 may be determined by, for example, multiplying the wireline diameter 504 by a peak offset factor of 0.2.

In like manner, a groove pitch 512 may be determined by multiplying the wireline diameter 504 with a groove pitch factor. The groove pitch factor may vary in accordance with a wireline diameter range. For instance, with a wireline diameter range of from less than 10 mm (millimeters) up to 10 mm, a groove pitch factor of 1.15 may be multiplied by the wireline diameter 504 to determine a groove pitch 512. In another example, with a wireline diameter range of 10 mm through 20 mm, a groove pitch factor of 1.12 may be multiplied by the wireline diameter 504 to determine a groove pitch 512. In a third example, with a wireline diameter range of from 20 mm through above 20 mm, a groove pitch factor of 1.10 may be multiplied by the wireline diameter 504 to determine a groove pitch 512.

Figure 6A:
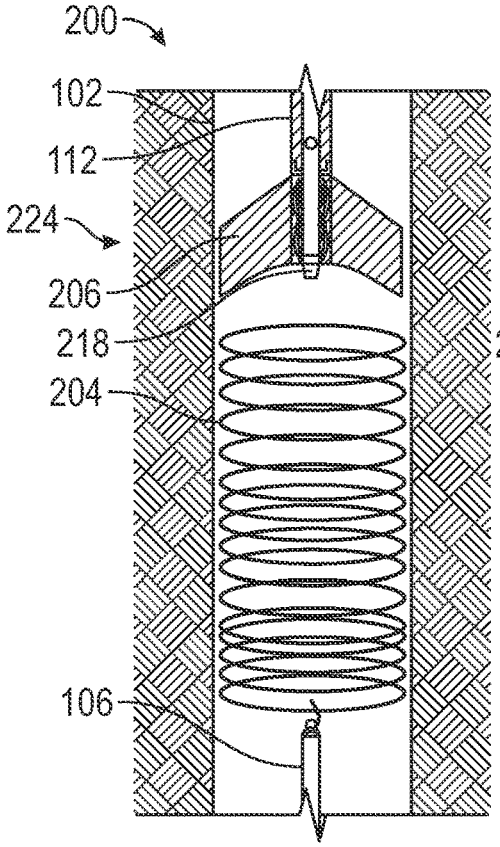
FIGS. 6A-6D show an operational sequence of a system in accordance with one or more embodiments.

FIGS. 6A-6D show the operational sequence of the system (200) in accordance with one or more embodiments. FIG. 6A shows a deployment phase. The spear (112) is shown deployed in the borehole (102) with the spear component (218) of the spear (112) shown in the inactivated spear position (224). The spear hook (222) is shown in the spear latched position (274). Compaction component 206 of the spear (112) is shown uphole from and prior to compacting the wireline (204). FIG. 6A also shows the fish (106).

Figure 6B:
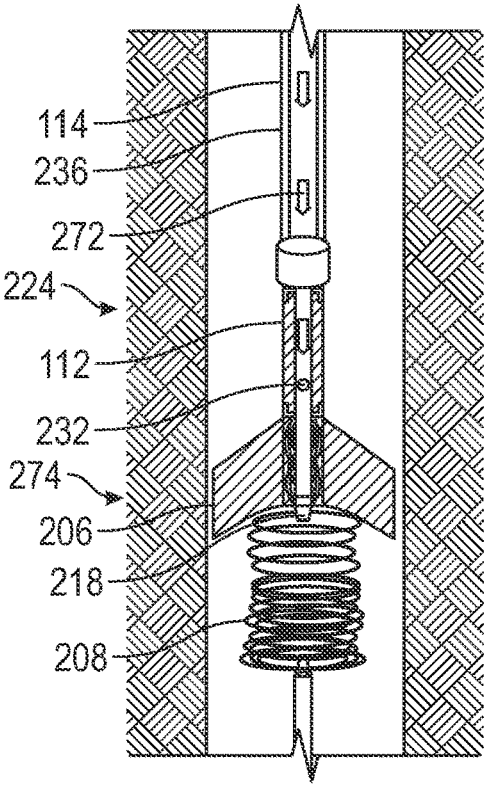

FIG. 6B shows a compaction phase. The spear component (218) of the spear (112) is shown still in the inactivated spear position (224) by being held inside the compaction component (206) by the weakpoint. In accordance with one or more embodiments the weakpoint may comprise the shear pin. The spear component (218) is retained in the compaction component (206) to prevent restricting the wireline compaction during the compaction phase. A downhole force may be applied to the wireline from the compaction component (206) on the spear (112). The downhole force may be conveyed from the surface through the drill pipe, or other conveyor, to the tool (110) and the spear (112).

FIG. 6B shows that the compaction component (206) of the spear (112) has gathered and compacted the loose wireline string downhole to form a compacted wireline (208). Once the desired depth is reached, the spear may be activated by dropping the ball (232) inside the conveyor (114). In accordance with one or more embodiments the conveyor (114) may comprise drill pipe (236). The ball (232) traverses down an internal bore of the drill pipe propelled by, for example, the force of gravity applied to the ball. The ball may also be pumped down the bore of the drill pipe using a substance such as a drilling mud. After the ball (232) lands on the ball seat (234), a ball-ball seat interface is formed. The ball cooperates with the ball seat to stop the flow of mud past the ball-ball seat interface.

A hydraulic pressure (272) is applied above, e.g., uphole of, the ball-ball seat interface thereby pressuring up against the ball. The hydraulic pressure (272) applied to the ball (232) results in a ball force. The ball force is approximated by the arithmetical difference between the pressure acting on the ball above the ball seat minus the pressure acting on the ball below the ball seat. For example, when the pressure acting on the ball above the ball seat exceeds the pressure acting on the ball below the ball seat, then the result is a downward ball force. In accordance with one or more embodiments the downward ball force may be directed downhole. The pressure above the ball, the pressure below the ball, and the ball-ball seat interface size may all be calibrated for a predetermined downward ball force.

Figure 6C:
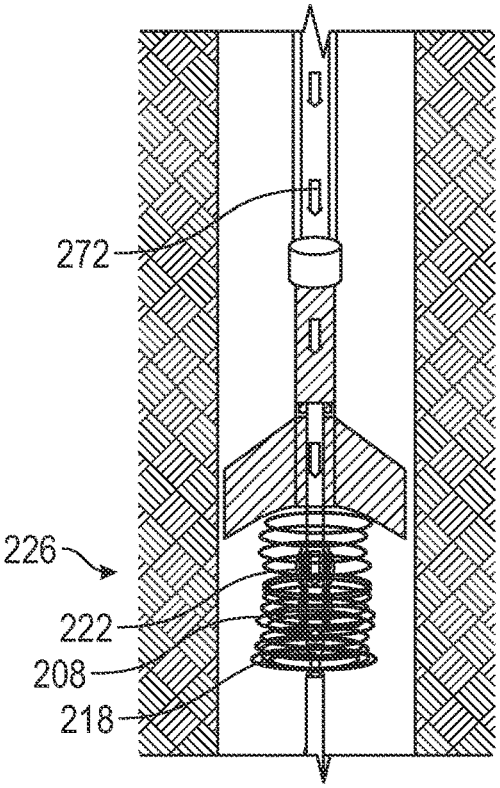

FIG. 6C shows a shearing phase. The hydraulic pressure (272) may continue to be applied until the pressure reaches a magnitude that is predetermined to result in a downward force that exceeds the predetermined parting force of the weakpoint. In accordance with one or more embodiments the predetermined parting force may exceed the predetermined parting force for which the shear pins were calibrated to shear, thereby shearing the shear pin or shear pins. Once the shear pin is sheared, the spear component (218) moves to the activated spear position (226). Continued application of the hydraulic pressure (272) deploys the spear hook (222) inside the compacted wireline (208).

Figure 6D:
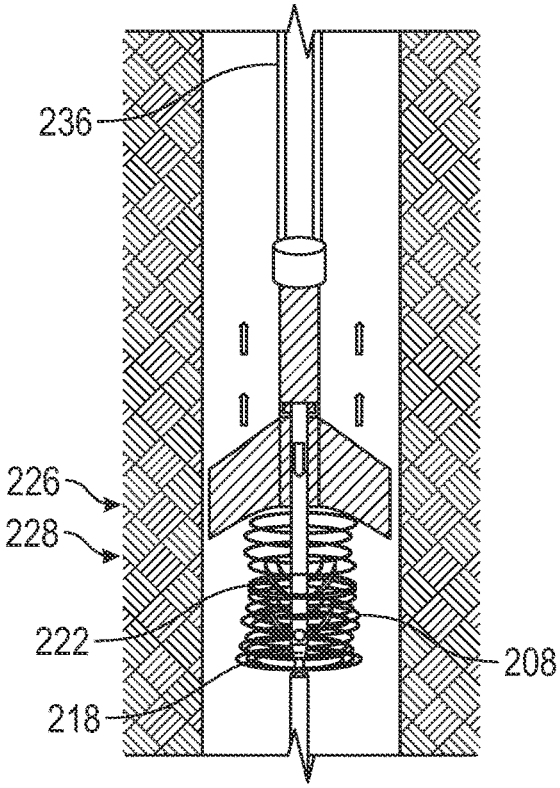

FIG. 6D shows a releasing phase. The drill pipe (236) is shown in FIG. 6D with the spear component (218) in the activated spear position (226) and the spear hook (222) in the released spear position, e.g., outside position (228). The drill pipe is shown being slowly pulled uphole thereby engaging the released spear hooks with the compacted wireline (208). The drill pipe (236) may continue to be raised thereby raising the tool (110) and the compacted wireline (208) in an uphole direction until exiting the borehole (102).

While FIGS. 1, 2, 3A, 3B, 3C, 4A-4F, 5A-5B, and 6A-6D show various configurations of hardware components and/or software components, other configurations may be used without departing from the scope of the disclosure. For example, various components in FIGS. 1, 2, 3A, 3B, 3C, 4A-4F, 5A-5B, and 6A-6D may be combined to create a single component. As another example, the functionality performed by a single component may be performed by two or more components.

Figure 7:
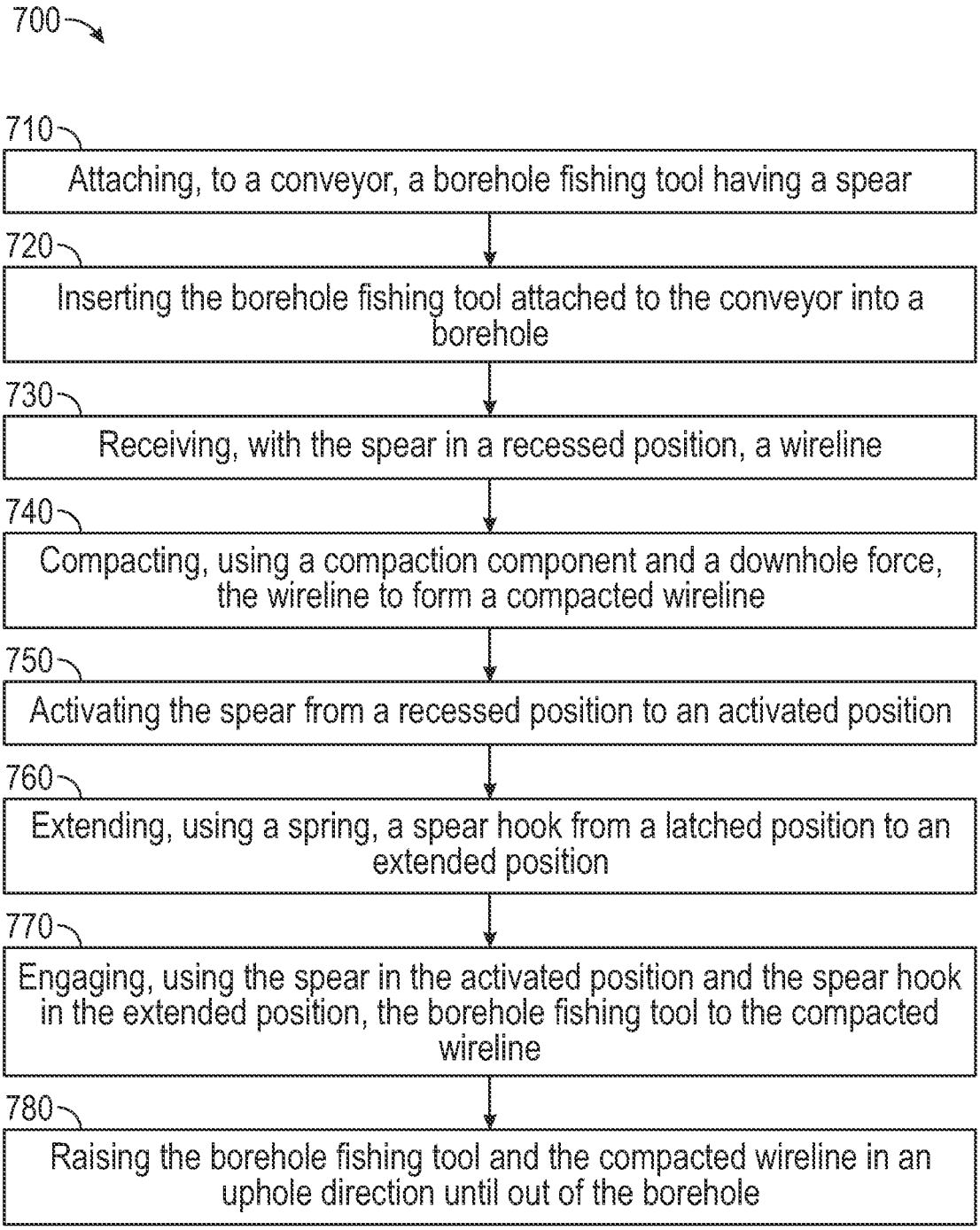
FIG. 7 shows a flowchart in accordance with one or more embodiments.

FIG. 7 shows a flowchart in accordance with one or more embodiments. Specifically, FIG. 7 describes a general method, e.g., a borehole fishing method (700), for fishing a wireline in a downhole environment. One or more blocks in FIG. 7 may be performed by one or more components (e.g., system 200) as described in FIGS. 1, 2, 3A, 3B, 3C, 4A-4F. 5A-5B, and 6A-6D. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

At step 710, the method includes attaching a borehole fishing tool ("tool") with a spear to a conveyor. The tool with a spear is attached to the conveyor which may be a drill pipe, a coiled tubing, the wired version of either, or another conveyor. For example, the tool may be attached to a drill pipe. The tool may further include a compaction component with a compaction surface.

At step 720, the tool attached to the conveyor is inserted into a borehole and conveyed downhole by the conveyor. The tool may be conveyed to a desired depth or a predetermined depth such as a target depth. The depth to which the tool is conveyed may be a location for retrieving a fish or a lost wireline.

At step 730, the method includes receiving a wireline. The tool, using the spear and with the spear in a recessed position, receives a wireline. At this step the tool may encounter the loose, lost wireline and receive it in a compaction bore of a compaction component. The spear may remain in the recessed position to allow room for the wireline in the space formed between the wireline and the compaction surface of the compaction bore.

At step 740, using the drill pipe, the tool, and the compaction bore, along with a downhole compacting force, the method includes the tool compacting the wireline to form a compacted wireline. The compaction bore groove or grooves may help keep the compressed waireline from blocking the pathway of the spear. The grooves may be configured to allow the wireline to accumulate without preventing the spear from reaching the bottom after activation. The grooves and the compaction bore may cooperate to accumulate the wireline and leave enough space remaining below the compaction bore to provide clearance for the spear to move from the inactivated spear position to the activated spear position.

At step 750, the method includes activating the spear from a recessed position to an activated position. Once the desired depth is reached, the spear may be activated by dropping a ball inside the drill pipe, then pumping the ball down to the ball seat. Upon landing on the ball seat, the method includes pressuring up against the ball and shearing the shear pin of the weakpoint thereby moving the spear from the inactivated spear position to the activated spear position. Once the shear pin is sheared, the pressure forces the spear inside the compacted wireline.

At step 760, the method includes extending a spear hook by releasing the spear hook from a latched position to an outside position. The spear hooks may rotate away from the spear body on a rotational path determined by the hook hinge. The outside position may be a spear hook extended position outside of the outside diameter of the spear body. Obstruction from the compacted wireline may prevent the spear hooks from fully extending to the outside position.

At step 770, the method includes engaging, using the spear in the activated position and the spear hook in the outside position, the borehole fishing tool to the compacted wireline. The spear hook may grip onto the compacted wireline thereby enabling a transfer of uphole force from the drill pipe to the wireline.

At step 780, the method includes raising the tool and the compacted wireline in an uphole direction until out of the borehole. The drill pipe may be pulled up to allow the release of the spear hooks. The spear hooks may continue to grip into the compacted wireline. The drill pipe may continue conveying the tool, the spear, and the wireline out of the borehole.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A borehole fishing tool, comprising:

a spear hook for gripping into a compacted wireline;

a spear that deploys the spear hook;

a hook hinge rotatably coupling the spear hook to the spear;

a hook activator mounted in the spear to cause expansion and contraction of the spear hook along a path defined by the hook hinge in a radial direction from a spear outer surface of the spear; and a compaction component, coupled to the spear, for compacting a wireline to form the compacted wireline wherein the compaction component comprises a ball seat disposed in a bore of the spear to cooperate with a ball and a ball force to activate the spear.

2. The borehole fishing tool of claim 1, wherein the compaction component comprises a concaved surface configured to cooperate with a downhole force to compact the wireline.

3. The borehole fishing tool of claim 1, wherein the compaction component comprises a plurality of grooves disposed on a compaction surface to accumulate the wireline.

4. The borehole fishing tool of claim 1, wherein the spear comprises a recessed position within the compaction component to allow the wireline to enter the compaction component.

5. The borehole fishing tool of claim 1, wherein the compaction component comprises an inactivated spear position to create a space for the wireline in the compaction component to allow the loose wireline to be compressed.

6. The borehole fishing tool of claim 1, wherein the spear is disposed in a spear recess of the compaction component.

7. The borehole fishing tool of claim 1, wherein the spear hook is held in a retracted position by an inner wall of the compaction component.

8. The borehole fishing tool of claim 1, further comprising a weak point connection releasably connecting the compaction component to the spear;

wherein the weak point connection is releasable by applying a downward force on the spear;

wherein the compaction component comprises an outer aperture and the spear comprises an inner aperture;

wherein the borehole fishing tool further comprises a shear pin disposed within the outer aperture and the inner aperture;

wherein the shear pin releasably connects the spear to the compaction component, and wherein the spear is exposed downhole by release of the weak point connection.

9. A borehole fishing method, comprising:

attaching, to a conveyor, a borehole fishing tool comprising a spear and a compaction component coupled to the spear, wherein the spear is initially mounted in a recessed position within the borehole fishing tool;

inserting the borehole fishing tool attached to the conveyor into a borehole;

receiving, with the spear in the recessed position, a wireline;

compacting, using the compaction component of the borehole fishing tool and a downhole force provided by the conveyor, the wireline to form a compacted wireline;

dropping a ball onto a ball seat coupled to the spear;

activating the spear from the recessed position to an activated position;

releasing, using a hook activator, a spear hook from a latched position to an outside position;

engaging, using the spear in the activated position and the spear hook in the outside position, the borehole fishing tool to the compacted wireline; and raising the borehole fishing tool and the compacted wireline in an uphole direction until exiting of the borehole.

10. The borehole fishing method of claim 9, wherein the conveyor is selected from a group comprising a string of drill pipe, a string of wired drill pipe, a coil tubing, a wired coil tubing.

11. The borehole fishing method of claim 9, wherein the compaction component comprises a concaved surface configured to cooperate with a downhole force to compact the wireline.

12. The borehole fishing method of claim 9, wherein the compaction component comprises a plurality of grooves disposed on a compaction surface to accumulate the wireline.

13. The borehole fishing method of claim 9, wherein the spear comprises a recessed position within the compaction component to allow the wireline to enter the compaction component.

14. The borehole fishing method of claim 9, wherein the compaction component comprises an inactivated spear position to create a space for the wireline in the compaction component to allow the loose wireline to be compressed.

15. The borehole fishing method of claim 9, wherein the spear is disposed in a spear recess of the compaction component.

16. The borehole fishing method of claim 9, wherein the spear hook is held in a retracted position by an inner wall of the compaction component.

17. The borehole fishing method of claim 9, further comprising:

applying a pressure to the spear to activate the spear.

18. The borehole fishing method of claim 9, wherein the borehole fishing tool further comprises a weak point connection releasably connecting the compaction component to the spear;

wherein the weak point connection is releasable by applying a downhole force on the spear;

wherein the compaction component comprises an outer aperture and the spear comprises an inner aperture;

wherein the borehole fishing tool further comprises a shear pin disposed within the outer aperture and the inner aperture;

wherein the shear pin releasably connects the spear to the compaction component;

wherein the spear is exposed downhole by release of the weak point connection; and wherein activating the spear further comprises exceeding a preselected load capacity using the shear pin calibrated to the preselected load capacity.

* * * * *